US011696610B2

(12) United States Patent
Lange et al.

(10) Patent No.: US 11,696,610 B2
(45) Date of Patent: Jul. 11, 2023

(54) PROTECTIVE HELMET

(71) Applicant: Schuberth GmbH, Magdeburg (DE)

(72) Inventors: Philipp Lange, Moeser (DE); Sven Bartels, Genthin (DE)

(73) Assignee: SCHUBERTH GMBH, Magdeburg (DE)

( * ) Notice: Subject to any disclaimer, the term of this patent is extended or adjusted under 35 U.S.C. 154(b) by 0 days.

(21) Appl. No.: 16/772,885

(22) PCT Filed: Dec. 12, 2018

(86) PCT No.: PCT/EP2018/084594

§ 371 (c)(1),
(2) Date: Jun. 15, 2020

(87) PCT Pub. No.: WO2019/115629

PCT Pub. Date: Jun. 20, 2019

(65) Prior Publication Data

US 2020/0305532 A1 Oct. 1, 2020

(30) Foreign Application Priority Data

Dec. 15, 2017 (DE) ..... 10 2017 130 109.7
Dec. 18, 2017 (DE) ..... 10 2017 130 373.1

(51) Int. Cl.
*A42B 3/04* (2006.01)
*A42B 3/30* (2006.01)
(Continued)

(52) U.S. Cl.
CPC ..... *A42B 3/0406* (2013.01); *A42B 3/063* (2013.01); *A42B 3/30* (2013.01); *A42C 2/002* (2013.01)

(58) Field of Classification Search
None
See application file for complete search history.

(56) References Cited

U.S. PATENT DOCUMENTS 3,422,224 A 1/1969 Curran
3,470,558 A 9/1969 Raschke
(Continued)

FOREIGN PATENT DOCUMENTS

CN 1627651 A 6/2005
CN 1715734 A 1/2006
(Continued)

OTHER PUBLICATIONS

A. Rajpurohit, "Fiber Reinforced Composites: Advances in Manufacturing Techniques.", Researchgate; https://www.researchgate.net/publication/279885386. (Year: 2014).*
(Continued)

*Primary Examiner* — Katherine M Moran
*Assistant Examiner* — Grady Alexander Nunnery
(74) *Attorney, Agent, or Firm* — McCarter & English, LLP

(57) ABSTRACT

The invention relates to a protective helmet, comprising an outer shell (1) for distributing impact forces and an antenna (2) for transferring a radio signal, which antenna is arranged at least partially inside the outer shell (1). The outer shell (1) consists of a main material in a main region (5). The protective helmet is characterized in that the outer shell (1) consists of a cut-out material in a cut-out region (6), the cut-out material having a lesser damping effect on the radio signal in comparison with the main material. The invention further relates to a method for producing a protective helmet.

19 Claims, 2 Drawing Sheets

(51) Int. Cl.
*A42C 2/00* (2006.01)
*A42B 3/06* (2006.01)

(56) References Cited

U.S. PATENT DOCUMENTS 3,582,951 A 6/1971 Altmayer
3,885,246 A 5/1975 Tung
3,963,917 A 6/1976 Romano
3,977,003 A 8/1976 Kershaw
4,077,007 A 2/1978 McKinney
4,109,105 A 8/1978 Von Statten, Jr.
4,130,803 A 12/1978 Thompson
4,152,553 A 5/1979 White
4,178,411 A 12/1979 Cole et al.
4,239,106 A 12/1980 Aileo
4,321,433 A 3/1982 King
4,357,711 A 11/1982 Drefko et al.
4,400,591 A 8/1983 Jennings et al.
4,466,138 A 8/1984 Gessalin
4,519,099 A 5/1985 Kamiya et al.
4,563,392 A 1/1986 Harpell et al.
4,719,462 A 1/1988 Hawkins
4,729,132 A 3/1988 Fierro
4,833,726 A 5/1989 Shinoda et al.
4,903,350 A 2/1990 Gentes et al.
4,950,439 A 8/1990 Smith et al.
5,119,505 A 6/1992 Tisseront et al.
5,136,567 A 8/1992 Nagahara et al.
5,136,657 A 8/1992 Hattori
5,142,700 A 8/1992 Reed
5,183,701 A 2/1993 Jacobs et al.
5,291,203 A 3/1994 Schneck
5,327,588 A 7/1994 Garneau
5,329,637 A 7/1994 Walker
5,357,409 A 10/1994 Glatt
5,438,702 A 8/1995 Jackson
5,448,780 A 9/1995 Gath
5,508,900 A 4/1996 Norman
5,615,410 A 3/1997 DeMars
5,683,831 A 11/1997 Baril et al.
5,718,004 A 2/1998 Broersma et al.
5,743,621 A 4/1998 Mantha et al.
5,749,096 A 5/1998 Fergason et al.
5,862,528 A 1/1999 Saijo et al.
5,886,667 A 3/1999 Bondyopadhayay
5,931,559 A 8/1999 Pfaeffle
5,996,128 A 12/1999 Yanagihara
6,009,563 A 1/2000 Swanson et al.
6,081,929 A 7/2000 Rothrock et al.
6,336,220 B1 1/2002 Sacks et al.
6,464,369 B1 10/2002 Vega et al.
6,691,325 B1 2/2004 Pelletier et al.
6,701,537 B1 3/2004 Stamp
7,377,666 B1 5/2008 Tyler
7,532,163 B2 5/2009 Chang et al.
7,555,312 B2 6/2009 Kim et al.
7,555,788 B2 7/2009 Schimpf
7,901,104 B2 3/2011 McLean et al.
8,001,623 B2 8/2011 Gertsch et al.
8,009,229 B1 8/2011 Peterson
8,245,326 B1 8/2012 Tolve
8,544,399 B2 10/2013 Miloslavsky
8,545,959 B2 10/2013 McGuire, Jr. et al.
8,667,617 B2 3/2014 Glezerman et al.
8,853,105 B2 10/2014 Bhatnagar et al.
8,908,389 B2 12/2014 Teetzel et al.
9,070,978 B2 6/2015 Boni et al.
9,247,779 B1 2/2016 Aloumanis et al.
9,445,639 B1 9/2016 Aloumanis et al.
9,456,649 B2 10/2016 Basson
9,486,027 B2 11/2016 Dey et al.
9,585,433 B1 * 3/2017 Heimer ..... A42B 3/063
9,686,136 B1 6/2017 Dey et al.
9,711,146 B1 7/2017 Cronin
9,833,933 B2 12/2017 Cadens Ballarin
9,968,153 B2 5/2018 Thompson et al.
10,051,908 B2 8/2018 Redpath et al.
10,160,156 B2 12/2018 Pourboghrat et al.
10,219,571 B1 3/2019 Aloumanis et al.
10,383,384 B2 8/2019 Zhavoronkov et al.
10,779,604 B2 9/2020 Lebel et al.
10,806,204 B2 10/2020 Pritz
10,814,524 B2 10/2020 Prins et al.
10,856,599 B1 12/2020 Cuenca
11,278,076 B2 3/2022 Suddaby
2005/0017911 A1 1/2005 Lee
2006/0232955 A1 10/2006 Labine
2006/0277664 A1 12/2006 Akhtar et al.
2007/0220662 A1 * 9/2007 Pierce ..... B29C 44/12 2/410
2007/0289044 A1 12/2007 Ellis
2008/0068825 A1 3/2008 Harris
2008/0130271 A1 6/2008 Harris
2009/0064386 A1 3/2009 Rogers
2009/0158508 A1 6/2009 Quaranta et al.
2009/0199317 A1 8/2009 Schwiers et al.
2010/0175172 A1 7/2010 Dempsey et al.
2010/0287687 A1 11/2010 Ho
2011/0302701 A1 12/2011 Kuo
2012/0011631 A1 1/2012 Crossman et al.
2012/0077438 A1 3/2012 Jung
2012/0189153 A1 7/2012 Kushnirov et al.
2012/0272435 A1 11/2012 Glezerman et al.
2013/0007949 A1 1/2013 Kurs et al.
2013/0081199 A1 4/2013 Nimura
2013/0176183 A1 7/2013 Boni et al.
2013/0190052 A1 * 7/2013 Lundell ..... H04M 1/0262 455/566
2013/0305437 A1 11/2013 Weller et al.
2014/0000013 A1 1/2014 Redpath et al.
2014/0000014 A1 1/2014 Redpath et al.
2014/0020159 A1 1/2014 Teetzel et al.
2014/0109297 A1 4/2014 Lanez
2014/0189938 A1 7/2014 Redpath et al.
2014/0362244 A1 12/2014 Martin
2015/0038199 A1 * 2/2015 Shiraishi ..... H05K 5/0086 455/575.7
2015/0223547 A1 8/2015 Wibby
2015/0282549 A1 10/2015 Lebel et al.
2016/0100649 A1 4/2016 Glezerman et al.
2016/0106174 A1 4/2016 Chung et al.
2016/0249700 A1 9/2016 Zhavoronkov et al.
2017/0006955 A1 1/2017 Dow, II et al.
2017/0052000 A1 2/2017 White et al.
2017/0367433 A1 12/2017 Frett
2018/0221915 A1 8/2018 Simor et al.
2018/0272928 A1 * 9/2018 Boksteyn ..... A42B 3/0453
2018/0289095 A1 10/2018 Catterson et al.
2019/0104797 A1 4/2019 Teetzel et al.
2019/0191808 A1 6/2019 Becker et al.
2019/0269193 A1 9/2019 Benyola
2019/0320753 A1 10/2019 Le et al.
2019/0380417 A1 12/2019 Zhavoronkov et al.
2019/0387829 A1 12/2019 Becker et al.
2020/0015537 A1 1/2020 Becker et al.
2020/0037693 A1 2/2020 Klimek et al.

FOREIGN PATENT DOCUMENTS

CN 201319192 Y 9/2009
CN 102791157 A 11/2012
CN 104871384 A 8/2015
CN 204949670 U 1/2016
CN 205106513 U 3/2016
CN 206043574 U 3/2017
CN 106659261 A 5/2017
CN 206312966 U 7/2017
DE 3042159 A1 6/1982
DE 8226935 U1 2/1983
DE 29519601 U1 2/1996
DE 29906107 U1 7/1999
DE 29914563 U1 1/2000
DE 102005038893 A1 3/2006
DE 202011051831 U1 11/2011

(56) References Cited

FOREIGN PATENT DOCUMENTS

| | | | | | |
|---|---|---|---|---|---|
| DE | 102015216835 | A1 | | 3/2017 | |
| DE | 102016115889 | A1 | | 3/2018 | |
| EP | 0412205 | A1 | | 2/1991 | |
| EP | 1393643 | A1 | | 3/2004 | |
| EP | 2183989 | A1 | | 5/2010 | |
| FR | 2335169 | A1 | | 7/1977 | |
| FR | 2668901 | A1 | | 5/1992 | |
| GB | 826012 | A | | 12/1959 | |
| GB | 974901 | A | | 11/1964 | |
| GB | 2059206 | A | * | 4/1981 | ..... A42B 3/30 |
| GB | 2254528 | A | | 10/1992 | |
| JP | S6468507 | A | | 3/1989 | |
| JP | 2000328342 | A | | 11/2000 | |
| JP | 2005060889 | A | | 3/2005 | |
| JP | 2011-002958 | A | | 1/2011 | |
| KR | 20010011095 | A | | 2/2001 | |
| KR | 101530061 | B1 | | 6/2015 | |
| WO | 2004032658 | A1 | | 4/2004 | |
| WO | 2011129576 | A2 | | 10/2011 | |
| WO | 2012006653 | A | | 1/2012 | |
| WO | 2012017836 | A1 | | 2/2012 | |
| WO | 2012148519 | A1 | | 11/2012 | |
| WO | 2016001915 | A1 | | 1/2016 | |
| WO | 2016022984 | A1 | | 2/2016 | |
| WO | 2018/043025 | A1 | | 3/2018 | |

OTHER PUBLICATIONS

Wikipedia, Wireless Personal Area Network, https://de.wikipedia.org/w/index.php?title=Wireless_Personal_Area_Network, printed Mar. 27, 2018, 4 pages.

International Search Report for Application No. PCT/EP2018/084594, dated Mar. 8, 2019, 4 pages.

Written Opinion for Application No. PCT/EP2018/084594, dated Mar. 8, 2019, 6 pages.

D'Hooghe et al., Thermoplastic Composite Technology; Tougher Than You Think. Adv Mat. 2000;12(23):1865-1868.

* cited by examiner

PROTECTIVE HELMET

CROSS-REFERENCE TO RELATED APPLICATIONS

This application is a national stage application of international application no. PCT/EP2018/084594 filed Dec. 12, 2018, entitled "Protective Helmet," claiming priority to German application nos. DE 10 2017 130 109.7, filed Dec. 15, 2017 and DE 10 2017 130 373.1, filed Dec. 18, 2017, which are hereby expressly incorporated by reference as part of the present disclosure.

FIELD OF THE INVENTION

The present disclosure generally relates to a protective helmet as well as a method for producing a protective helmet.

BACKGROUND

Wearing a protective helmet is required for many activities, including regularly when driving a motorcycle. Not only a protective helmet of this type with its safety-related and extensive coverage of the driver's head, but also the noise resulting from the motorcycle's engine and the road noises makes the unaided oral communication of motorcyclists difficult or impossible from a practical point of view during the journey.

In the course of more recent technological developments, wireless radio connections and corresponding arrangements of microphones and earphones enable motorcyclists to communicate with one another, even in a relatively large group and during the journey. An important aspect in this respect is the maximum possible distance between the communication participants. It is obvious that, on the one hand, even relatively large distances can exist or arise between the individual motorcyclists—e.g., if the group is separated from one another by a traffic light or the like or disperses on a relatively long stretch—and that, on the other hand, the transmission power should not be arbitrarily increased. This is mainly because the corresponding devices on a motorcycle are regularly operated by batteries, which are not easy to charge on the go, and also the exposure of the driver to radio waves should not be excessively increased.

As well as the special type of radio communication used, the antenna and its positioning also play an important role in terms of the range. The antenna is regularly arranged on the protective helmet itself for this communication. Since the microphone and the loudspeaker are regularly mounted on the protective helmet anyway, the need to provide a separate component that would have to be held or mounted in a different way, is in this way negated. The arrangement on the protective helmet also enables the antenna to be effectively protected from damage.

In this context, WO 2012/148519 A1 proposes a protective helmet having an integrated antenna, which antenna is arranged inside the outer shell.

It may be the case, however, that a material that for mechanical reasons and, possibly, for manufacturing reasons is particularly suitable for the outer shell, has unfavorable properties for positioning the antenna regarding a damping effect on the radio signals. This is the case in particular for fiber composites with carbon fibers. Although these have an encouragingly low weight, which is an important consideration in particular for a helmet, they cause a relatively strong damping of electromagnetic waves. This reduces the range of an antenna, the radio signals of which should pass through the outer shell.

SUMMARY

It is therefore an objective to further develop and improve the protective helmet having an antenna as well as a corresponding production method such that an improved range can be achieved whilst maintaining the desired mechanical properties as far as possible.

In at least some embodiments a partial region can be provided in the outer shell of the protective helmet, which partial region has a lower damping for radio signals because it is made of another and in this regard more suitable material. An improved range for the communication with the antenna can be achieved as a result of a suitable positioning of the antenna also on the inside of the outer shell, without significant compromises having to be made in terms of mechanics or otherwise. As such, an increased weight of this other material is then negligible, if the partial region is small compared to the rest of the outer shell.

The protective helmet in at least some embodiments, which can be a motorcycle protective helmet, has an outer shell for distributing impact forces and an antenna, arranged at least partially inside the outer shell, for transmitting a radio signal, wherein the outer shell consists of a main material in a main region. The radio signal can be any analogue or digital signal possibly in accordance with, in principle, any communication protocol. The antenna can be set up to transmit and, alternatively or additionally, to emit the radio signal. The arrangement of the antenna at least partially inside the outer shell means that at least one part of the outer shell is arranged between the antenna and an outside of the outer shell. For example, it is possible that the antenna is surrounded by the outer shell both on the inside and on the outside. The inside of the outer shell is concave and corresponds to the direction towards the head of a wearer of the protective helmet. The outside of the outer shell is correspondingly convex. The main region is a part of the outer shell. The main material is, in principle, any material.

In at least some embodiments, the outer shell consists of a cut-out material in a cut-out region, which has a lower damping effect on the radio signal compared to the main material. The cut-out region is a part of the outer shell that does not overlap with the main region and can be smaller than the main region. The outer shell may consist of the main region and the cut-out region. The damping effect in the present sense is damping by means of dielectric adsorption.

The main material can, in principle, be any material. In at least some embodiments the main material is a main fiber composite having a main fiber material. The main fiber material can be fibers from any material or fibers of any different materials. The main fiber composite is correspondingly, in principle, any fiber composite.

In at least some embodiments, the cut-out material consists of a secondary fiber composite. The secondary fiber composite can also be, in principle, any fiber composite. In at least some embodiments, the secondary fiber composite has a secondary fiber material that is different from the main fiber material. The secondary fiber composite can also have a plurality of different secondary fiber material, which is possibly also distributed unevenly in regions. In these cases, the lower damping of the cut-out material can be due to the correspondingly different properties of the secondary fiber material. The secondary fiber material can have a lower in particular specific damping effect on the radio signal than the main fiber material. The specific damping effect in this case is the damping effect related to a volume unit of the secondary fiber material. In other words, the secondary fiber material has a lower dielectric adsorption than the main fiber material. The secondary fiber material may include glass fibers, aramid fibers and/or polyethylene fibers or consists of them. The secondary fiber material and, alternatively or in addition, the main fiber material can take the form of a scrim, woven fabric, knitted fabric or other textile structure.

In at least some embodiments, the protective helmet is characterised in that the main fiber composite has a main matrix material for embedding the main fiber material. The main matrix material can, when cured, form the main fiber composite with the main fiber material. It can also be the case that the secondary fiber composite has a secondary matrix material for embedding the secondary fiber material. The secondary matrix material can correspondingly, when cured, form the secondary fiber composite with the secondary fiber material. The main matrix material and/or the secondary matrix material can comprise vinyl ester resin or consist of it.

In at least some embodiments, the main fiber material has carbon fibers. The main fiber material can also substantially consist of carbon fibers. In principle, the secondary matrix material can also be different from the main matrix material. In at least some embodiments, the main matrix material substantially corresponds to the secondary matrix material in its composition. In this case, the same matrix material can be used for the outer shell as a whole.

In at least some embodiments, the main region and the cut-out region are integrally bonded together. In this way, mechanically disadvantageous irregularities can be effectively avoided. In at least some embodiments, the main region and the cut-out region are integrally bonded together by the main matrix material and the secondary matrix material. In at least some embodiments, the main region and the cut-out region are integrally bonded by means of curing the main matrix material and the secondary matrix material. As already described, these two materials can be substantially the same material. In at least some embodiments, the main region and the cut-out region are substantially exclusively integrally bonded together along their border. This border is the border between the main region and cut-out region. In at least some embodiments, there is an even transition between the main region and the cut-out region along the border. In other words, the above transition is continuous in particular on the outside of the outer shell. Finally, in at least some embodiments, the outer shell is molded in one piece.

In at least some embodiments, the cut-out region adjoins the main region in at least three directions on the outer shell. These three directions are among the four directions respectively perpendicular to or opposite each other on the two-dimensional plane formed by the outside or inside of the outer shell. Adjoining in exactly three directions is then, for example, the case if the cut-out region adjoins an edge of the outer shell and is otherwise completely surrounded by the main region. Even without adjoining the edge of the outer shell like this, in at least some embodiments the cut-out region is completely surrounded by the main region, in that it adjoins the main region in four directions in the above sense.

In principle, the antenna can be arranged anywhere in relation to the outer shell. In at least some embodiments, the antenna touches the outer shell. This means that the antenna is in contact with the outer shell. For example, the antenna may touch the cut-out region. In this way, the low damping effect of the cut-out region comes into effect effectively. Alternatively or in addition, it may be the case that the antenna is arranged in a bag-like pocket of the outer shell. Finally, it may be the case that the antenna is attached to an inside of the outer shell.

In principle, the antenna cannot touch the outer shell at all, in a partial section or even only at certain points. In at least some embodiments, the antenna extends substantially completely along one extension region/portion of the outer shell. In other words, the antenna as a whole is in contact with the outer shell. The region of the outer shell in contact with the antenna is the extension region. In this context, in at least some embodiments the extension region is substantially completely surrounded by the cut-out region. Moreover, a safety distance from the main region/portion can be provided. In at least some embodiments, the extension region maintains a minimum distance from the main region, which is in at least some embodiments at least 10 mm.

It is, however, not just the part of the outer shell that is situated closest to the antenna that is relevant regarding the damping. An antenna regularly has a mirror-symmetrical radiation pattern, such that two opposite radiation directions emanating from the antenna are regularly particularly relevant in terms of damping. If the antenna is positioned accordingly on the outer shell, it is not just the region of the outer shell directly adjoining the antenna, but also the opposite region, relative to a center of the protective helmet, that is relevant. In at least some embodiments, therefore, the outer shell is designed concave for partially enclosing the head of a wearer of the protective helmet, such that said shell defines a center point in accordance with a center of the head, in that a point reflection of at least one part of the cut-out region defines a mirror region about the center point and in that a mirror region radio path, starting from the antenna and leading through the mirror region, of the radio signal has a lower damping than a main region radio path, leading through the main region, of the radio signal. In other words, the region opposite the antenna also has a reduced damping. There regularly exists a theoretically unlimited number of radio paths from the antenna through the mirror region, i.e., of mirror region radio paths. It suffices here for there to be reduced damping for at least one such mirror region radio path. There does not therefore have to be reduced damping for all conceivable mirror region radio paths. Furthermore, the above statement that the mirror region radio path originates from the antenna merely defines the course of the mirror region radio path and does not restrict the direction of the radio signals—corresponding to a transmission from the antenna or reception by the antenna—to this path.

The reduced damping described in this way can, in principle, be achieved in various ways. In at least some embodiments, the mirror region overlaps an opening region of the outer shell. In other words, there is a mirror region radio path that does not pass through the outer shell. The opening region can, for example, be the visor opening or the head opening for putting on the helmet.

In at least some embodiments, the cut-out region overlaps with the mirror region. In other words, at least one part of the mirror region also consists of the cut-out region. It may further be the case here that the cut-out region has several parts, that a first contiguous cut-out partial region comprises the extension region, that a second contiguous cut-out partial region overlaps with the mirror region and that the main region separates the first and the second contiguous cut-out regions from one another. In other words, there are two non-contiguous partial regions of the cut-out region.

In at least some embodiments, the protective helmet has an inner layer accommodated by the outer shell for damping impact forces. In at least some embodiments, at least one part of the outer shell is arranged between the antenna and the inner layer.

In principle, the antenna can have any shape or design. However, in at least some embodiments the antenna has a larger expansion along a longitudinal direction than along a transverse direction running transverse to the longitudinal direction. In other words, the antenna is elongated. In at least some embodiments, the antenna is arranged such that the longitudinal direction is oriented substantially vertically.

In at least some embodiments, the antenna is arranged on the outer shell substantially centrally relative to an outer shell transverse direction, which outer shell transverse direction is defined by a left and a right lateral direction of a wearer of the protective helmet.

In at least some embodiments, the protective helmet has a transmission line for coupling the antenna to a communication device. According to a first variant, the protective helmet has a slot for the in particular interchangeable accommodation of the communication device and this slot has a contact arrangement for connecting the communication device with the transmission line. A second variant envisages that the protective helmet has a connection arrangement for connecting an external contact to the transmission line. In such a case, the communication arrangement is not arranged on the protective helmet, but rather an electrical connection, e.g., by means of a cable, is merely established with the transmission line. In at least some embodiments, the communication device is a digital communication device such as a Bluetooth communication device. Accordingly, in at least some embodiments, the antenna is set up to transmit digital radio signals, wherein these can be Bluetooth radio signals.

In the method for producing a protective helmet having an outer shell for distributing impact forces, a main fiber material for forming a main fiber composite in a main region of the outer shell is arranged in a molding device for molding the outer shell. In other words, the main fiber material is arranged in the molding device for molding the outer shell such that it forms a main fiber composite in the main region of the outer shell. A main matrix material surrounding the main fiber material is further cured for embedding the main fiber material, wherein a cut-out region of the outer shell is formed from a cut-out material, wherein an antenna for transmitting a radio signal is arranged at least partially inside the outer shell and wherein the cut-out material has a lower damping effect on the radio signal compared to the main fiber composite.

In at least some embodiments, the cut-out material has a secondary fiber material, wherein the secondary fiber material is arranged in the molding device together with the main fiber material. In at least some embodiments, a secondary matrix material surrounding the secondary fiber material is cured for embedding the secondary fiber material, wherein this may occur substantially at the same time as the main fiber material is cured. By curing the secondary matrix material surrounding the secondary fiber material, the secondary matrix material together with the secondary fiber material forms a secondary fiber composite. In at least some embodiments, the secondary matrix material has substantially the same composition as the main matrix material.

This summary is not exhaustive of the scope of the present aspects and embodiments. Thus, while certain aspects and embodiments have been presented and/or outlined in this summary, it should be understood that the present aspects and embodiments are not limited to the aspects and embodiments in this summary. Indeed, other aspects and embodiments, which may be similar to and/or different from, the aspects and embodiments presented in this summary, will be apparent from the description, illustrations, and/or claims, which follow.

It should also be understood that any aspects and embodiments that are described in this summary and do not appear in the claims that follow are preserved for later presentation in this application or in one or more continuation patent applications.

BRIEF DESCRIPTION OF THE DRAWINGS

Other details, features, objectives and advantages are explained in the following description with reference to the Figures, which are understood not to be limiting, in which.

DETAILED DESCRIPTION OF EMBODIMENTS

Figure 1:
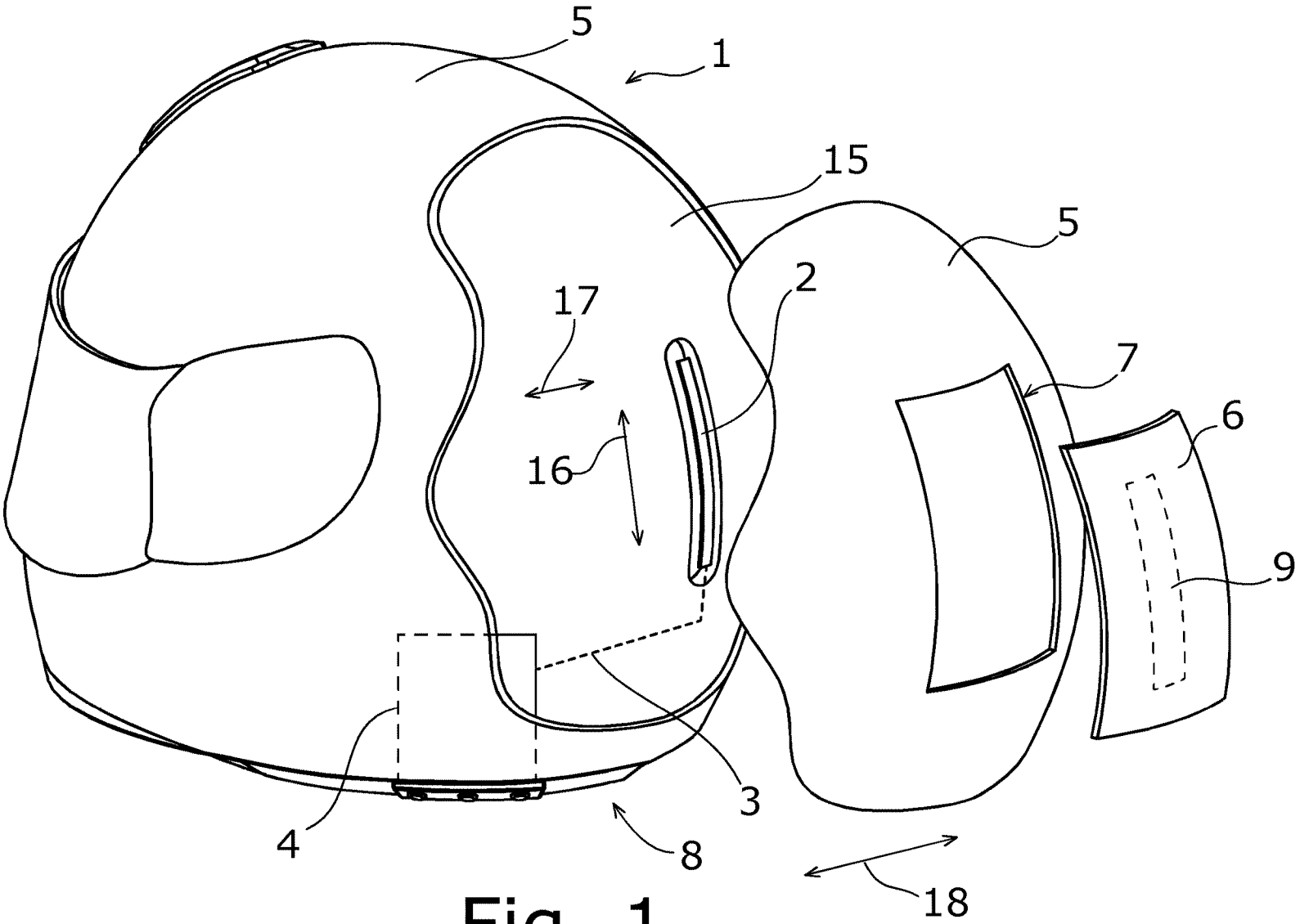
FIG. 1 shows a schematic exploded view of an exemplary embodiment of a proposed protective helmet.

The protective helmet shown in FIG. 1 is a motorcycle protective helmet. It has an outer shell 1, which is especially represented in an exploded view in FIG. 1. The protective helmet also has an antenna 2, which is set up here for a Bluetooth communication and is especially connected for this purpose by means of a transmission line 3 having a contact arrangement of a slot 4 for accommodating a communication device (not illustrated separately here). The communication device sends and receives radio signals by means of the antenna 2.

In a main region 5, the outer shell 1 consists of a main material, which is a fiber composite having carbon fibers as fiber material and vinyl ester resin as matrix material. This main material can also be designated a main fiber composite. In a cut-out region 6 that is different from the main region 5, the outer shell 1 consists of a cut-out material which here consists of a further fiber composite, which comprises glass fibers as fiber material and likewise vinyl ester resin as matrix material. This further fiber composite can also be designated a secondary fiber composite. The use of glass fibers leads to the damping effect of the secondary fiber composite on the radio signals being lower than the damping effect of the main fiber composite. The damping effect of the cut-out region 6 is therefore lower than that of the main region 5. The vinyl ester resin is the same for the main region 5 and the cut-out region 6.

When producing the outer shell 1, the carbon fibers and the glass fibers were respectively inserted into the corresponding molding device as scrim in accordance with the desired arrangement of the cut-out region 6. A collective impregnation with the vinyl ester resin and then curing of the vinyl ester resin subsequently took place. In this way, an exclusively bonded connection was created between the cut-out region 6 and the main region 5 by means of the vinyl ester resin along the border 7 between the cut-out region 6 and the main region 5. As can be seen in FIG. 1, the main region 5 surrounds the cut-out region 6 completely. Alternatively, the cut-out region 6 could extend as far as the lower edge 8 of the outer shell 1.

The antenna 2 is elongated and extends longitudinally along the cut-out region 6. A corresponding longitudinal direction 16 as well as a transverse direction 17 running transverse to the longitudinal direction 16 are illustrated in FIG. 1. The corresponding contact surface of the antenna 2 defines an extension region 9 indicated in FIG. 1, which lies completely within the cut-out region 6 and has a distance from the main region 5. The present arrangement of the antenna 2 leads to a substantially vertical orientation, when the protective helmet is worn.

The radiation pattern of the antenna 2 is such that a first main direction passes through the cut-out region 6 substantially perpendicular to the outer shell 1. The second main direction of the antenna 2 extends exactly opposite. This fact is illustrated in more detail in FIG. 2.

Figure 2:
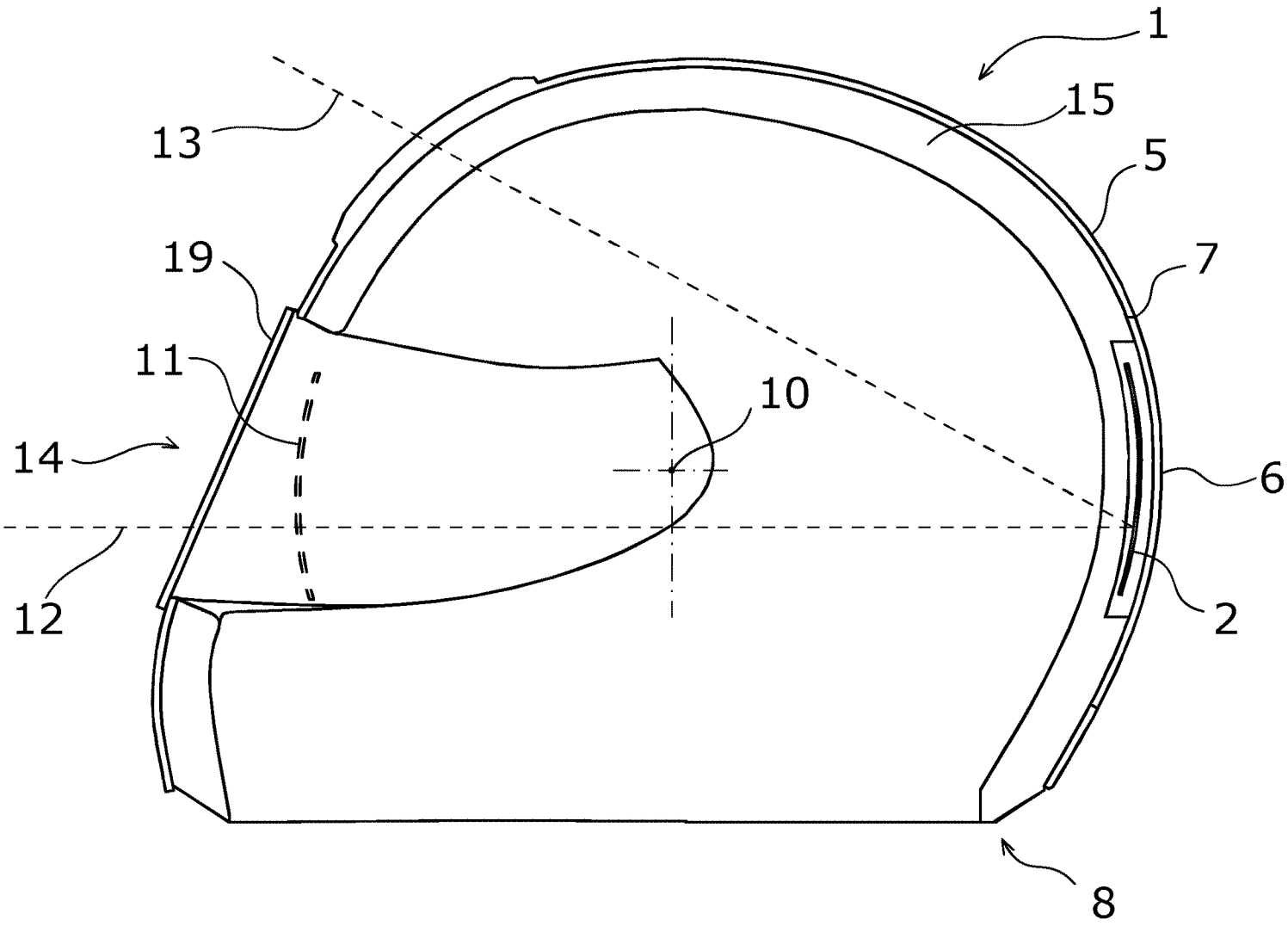
FIG. 2 shows a schematic side view of the protective helmet of FIG. 1.

It can be seen from the schematic illustration in FIG. 2 that the outer shell 1 defines a center point 10 in accordance with the center of the head of a wearer of the protective helmet. A mirror region 11 (only shown here in side view) is defined by a point reflection of the cut-out region 6. A radio path of the radio signal starting from the antenna 2 and leading through this mirror region 11 defines a mirror region radio path 12. It has a lower damping of the radio signal than the main region radio path 13 likewise illustrated in FIG. 2, which leads through the main region 5 starting from the antenna 2. The lower damping in the exemplary embodiment of FIGS. 1 and 2 can be explained by the fact that the mirror region 11 is arranged in the visor opening and because of this opening there is no damping by the outer shell 1 along the mirror region radio path 12. The damping by the visor 19 is considerably lower. The mirror region 11 therefore overlaps with an opening region 14 formed by the visor opening. It would also, however, be conceivable that although the mirror region 11 is in the outer shell 1, the outer shell 1 in the mirror region 11 also consists of a material that has a lower damping effect compared to the main material of the main region 5. The mirror region 11 would thus also be in the cut-out region 6, wherein the cut-out region 6 can also consist of a plurality of partial regions possibly not connected to one another.

Alongside the outer shell 1, the protective helmet shown in FIGS. 1 and 2 also has an inner layer 15 for damping impact forces, which consists of expanded polystyrene (EPS) in the present case. The outer shell transverse direction 18 defined by the left and right lateral direction of a wearer of the protective helmet, which direction, in principle, must be differentiated from the above transverse direction 17 relative to the antenna 2, substantially corresponds to the transverse direction 17 in the present exemplary embodiment.

While the above describes certain embodiments, those skilled in the art should understand that the foregoing description is not intended to limit the spirit or scope of the present disclosure. It should also be understood that the embodiments of the present disclosure described herein are merely exemplary and that a person skilled in the art may make any variations and modification without departing from the spirit and scope of the disclosure. All such variations and modifications, including those discussed above, are intended to be included within the scope of the disclosure.

The invention claimed is:

1. A protective helmet comprising:

an outer shell adapted to distribute impact forces; and an antenna located at least partially inside the outer shell and configured to transmit a radio signal;

wherein the outer shell defines a main portion formed of a main material including a main fiber composite including a main matrix material and a main fiber material and a cut-out portion adjacent to the main portion and formed of a cut-out material including a secondary fiber composite including a secondary matrix material and a secondary fiber material, wherein the cut-out material defines a lower damping effect on a radio signal compared to the main material, the main matrix material corresponds to the secondary matrix material in its composition, and the secondary fiber material is different from the main fiber material, wherein the outer shell defines an extension portion and the antenna extends substantially completely along the extension portion, and wherein the extension portion is spaced from the main portion by at least 10 mm.

2. The protective helmet according to claim 1, wherein the main fiber material includes carbon fibers.

3. The protective helmet according to claim 1, wherein the main portion and the cut-out portion are integrally bonded together.

4. The protective helmet according to claim 1, wherein the cut-out portion adjoins the main portion along at least three directions on the outer shell.

5. The protective helmet according to claim 1, wherein the antenna contacts the outer shell.

6. The protective helmet according to claim 1, wherein the outer shell defines a concave shape configured to partially enclose a head of a wearer of the protective helmet and defines a center point configured to substantially correspond with a center of the head of a wearer when worn, a point reflection about the center point of at least one portion of the cut-out portion defines a mirror region, and a mirror region radio path for said radio signal, starting from the antenna and extending through the mirror region, defines a lower damping than a main portion radio path for said radio signal extending through the main portion.

7. The protective helmet according to claim 6, wherein the outer shell defines an opening and the mirror region overlaps the opening.

8. The protective helmet according to claim 6, wherein the cut-out portion overlaps with the mirror region.

9. The protective helmet according to claim 8, wherein the cut-out portion defines a first contiguous cut-out partial portion defining the extension portion and a second contiguous cut-out partial portion defining the mirror region, and the main portion separates the first contiguous cut-out partial portion from the second contiguous cut-out partial portion.

10. The protective helmet according to claim 1, wherein the protective helmet defines an inner layer within the outer shell configured to damp impact forces.

11. The protective helmet according to claim 1, wherein the antenna extends in a longitudinal direction of the helmet more than in a transverse direction thereof that extends transversely to the longitudinal direction.

12. The protective helmet according to claim 11, wherein longitudinal direction is oriented substantially vertically.

13. The protective helmet according to claim 1, wherein the antenna is positioned on the outer shell substantially centrally relative to an outer shell transverse direction defined by a left and a right lateral direction of a wearer of the protective helmet.

14. The protective helmet according to claim 1, wherein the extension portion is substantially completely surrounded by the cut-out portion.

15. The protective helmet according to claim 1, wherein the antenna contacts the cut-out portion.

16. The protective helmet according to claim 1, wherein the secondary fiber material defines a lower damping effect on a radio signal compared to the main fiber material.

17. A protective helmet comprising:

an outer shell adapted to distribute impact forces; and an antenna located at least partially inside the outer shell and configured to transmit a radio signal;

wherein the outer shell defines a main portion formed of a main material and a cut-out portion formed of a cut-out material, wherein the cut-out material defines a lower damping effect on a radio signal compared to the main material, wherein the outer shell defines a concave shape configured to partially enclose a head of a wearer of the protective helmet and defines a center point configured to substantially correspond with a center of the head of a wearer when worn, a point reflection about the center point of at least one portion of the cut-out portion defines a mirror region, at least part of which consists of the cut-out portion, and a mirror region radio path for said radio signal, starting from the antenna and extending through the mirror region, defines a lower damping than a main portion radio path for said radio signal extending through the main portion, and wherein the cut-out portion overlaps with the mirror region; and wherein the cut-out portion defines a first contiguous cut-out partial portion defining an extension portion and a second contiguous cut-out partial portion defining the mirror region, and the main portion separates the first contiguous cut-out partial portion from the second contiguous cut-out partial portion.

18. A method comprising:

producing a protective helmet including an outer shell adapted to distribute impact forces and defining a main portion and a cut-out portion, said producing step including arranging in a molding device a main fiber material in the main portion of the outer shell for molding the outer shell;

surrounding the main fiber material with a main matrix material;

curing the main matrix material and, in turn, embedding the main fiber material therein and forming a main fiber composite;

locating an antenna at least partially inside the outer shell that is configured to transmit a radio signal; and forming the cut-out portion of the outer shell adjacent to the main portion with a cut-out material including a secondary fiber composite including a secondary matrix material and a secondary fiber material;

wherein the cut-out material defines a lower damping effect on a radio signal compared to the main fiber composite, the main matrix material corresponds to the secondary matrix material in its composition, and the secondary fiber material is different from the main fiber material, wherein the outer shell defines an extension portion and the antenna extends substantially completely along the extension portion, and wherein the extension portion is spaced from the main portion by at least 10 mm.

19. The method according to claim 18, wherein the secondary fiber material defines a lower damping effect on a radio signal compared to the main fiber material.

* * * * *